US010077536B2

(12) United States Patent
Druce

(10) Patent No.: US 10,077,536 B2
(45) Date of Patent: Sep. 18, 2018

(54) DRAINAGE SYSTEM

(71) Applicant: Bunker Dry Pty Ltd, Chatswood, New South Wales (AU)

(72) Inventor: Russell Edmund Druce, Hornsby (AU)

(73) Assignee: Bunker Dry Pty Ltd, Chatswood, New South Wales (AU)

( * ) Notice: Subject to any disclaimer, the term of this patent is extended or adjusted under 35 U.S.C. 154(b) by 0 days.

(21) Appl. No.: 15/527,946

(22) PCT Filed: Nov. 23, 2015

(86) PCT No.: PCT/AU2015/000709

§ 371 (c)(1),
(2) Date: May 18, 2017

(87) PCT Pub. No.: WO2016/077873

PCT Pub. Date: May 26, 2016

(65) Prior Publication Data

US 2017/0356150 A1 Dec. 14, 2017

(30) Foreign Application Priority Data

Nov. 21, 2014 (AU) ..... 2014904705

(51) Int. Cl.
*E02B 11/00* (2006.01)
*E01C 13/02* (2006.01)

(52) U.S. Cl.
CPC ..... *E02B 11/005* (2013.01); *E01C 13/02* (2013.01); *E02B 11/00* (2013.01)

(58) Field of Classification Search
CPC ..... E01C 13/083; E03F 5/04; E03F 1/003
USPC ..... 405/41, 42, 48; 138/42, 89
See application file for complete search history.

(56) References Cited

U.S. PATENT DOCUMENTS 1,015,530 A 1/1912 Appelman
1,123,888 A 1/1915 Kempf
1,606,990 A * 11/1926 Funk ..... E02B 11/00 405/42

(Continued)

FOREIGN PATENT DOCUMENTS

CA 1189550 A1 6/1985
GB 267817 A 3/1927

OTHER PUBLICATIONS

International Search Report pertaining to PCT/AU2015/000709 (3 pages).

(Continued)

*Primary Examiner* — Sean D Andrish
(74) *Attorney, Agent, or Firm* — Dinsmore & Shohl

(57) ABSTRACT

A drainage system (1300) comprising a cap (1302) having one or more sidewalls defining a recess (1326) and a body (1304). The body (1304) comprises an inlet at a first end (1312) of the body (1304), receivable within the recess (1326) of the cap (1302), an outlet at a second end (1384) of the body (1304), and a passage (1310) to allow fluid flow from the inlet to the outlet. The system (1300) further comprises a spacer arrangement (1306) to space the body (1304) from the cap (1302) when the inlet is received in the recess (1326) of the cap (1302), so as to form a channel to allow fluid flow to the inlet between an outer surface of the body (1304) and an inner surface of the cap (1302).

19 Claims, 11 Drawing Sheets

(56) References Cited

U.S. PATENT DOCUMENTS

| | | | | |
|---|---|---|---|---|
| 4,659,251 | A * | 4/1987 | Petter | B65D 90/105 137/312 |
| 4,685,827 | A * | 8/1987 | Sibbel | A01G 27/005 239/542 |
| 5,975,797 | A * | 11/1999 | Thomas | A01G 25/06 405/36 |
| 6,142,705 | A | 11/2000 | Edwards et al. | |
| 2003/0118403 | A1 | 6/2003 | Wilkerson | |
| 2003/0198514 | A1 | 10/2003 | McCampbell | |
| 2013/0098472 | A1* | 4/2013 | Farkas | E03F 5/04 137/15.01 |
| 2013/0174921 | A1 | 7/2013 | Schluter | |
| 2015/0167884 | A1* | 6/2015 | King | F16L 41/045 285/197 |

OTHER PUBLICATIONS

Written Opinion pertaining to PCT/AU2015/000709 (5 pages).
Supplementary European Search Report dated Jul 17, 2018 in reference to co-pending European Patent Application No. 15861534.
European Search Opinion dated Jul. 17, 2018 in reference to co-pending European Patent Application No. 15861534.

* cited by examiner

DRAINAGE SYSTEM

TECHNICAL FIELD

The present invention has application to the field of drainage systems and has particular, but by no means exclusive, application to drainage systems for use in bunkers of a golf course.

BACKGROUND ART

A golf course bunker is a deliberately positioned hazard on a golf course that is designed to increase the difficulty of playing on a golf course. A bunker is best described as being an area of ground on the course from which turf and soil have been removed to create a substantially sized hollow. The removed turf and soil is replaced with sand. Bunkers on a golf course are commonly located near greens, but can also be located alongside fairways. Bunkers are also commonly referred to as "sand traps" or just "traps".

Due to physical characteristics of a bunker, a large hollow in the ground, they are more susceptible to poor rainwater drainage than other parts of a golf course. For instance, rain on a fairway generally tends to be dispersed over a large area that is relatively flat or is slightly inclined or undulating. The benefit of this is that most rain (with the exception of the heaviest downpours) tends to be dispersed reasonably quickly. In contrast, however, because of the hollowed out nature of bunkers rainwater tends to collect at the bottom of the bunkers requiring considerable time to drain away naturally.

As a consequence of the additional time required for rainwater to drain from bunkers it is not uncommon for bunkers to be "taken out of play" while the bunkers dry out, which detracts from the playing experience of the golf course.

In order to minimize the time that bunkers are "taken out of play" drainage systems can be installed into the bunkers. Existing drainage systems can improve the rate at which rainwater is drained from the bunkers to reduce the amount of time bunkers are taken out of play. However, existing drainage systems used in bunkers regularly become blocked as sand from the bunker is drawn into the drainpipe. Some existing drainage systems seek to address the problem of sand blockages by using a small aperture for allowing water to enter and be drained away while restricting entry of sand, but the smaller aperture reduces water flow requiring more time to drain the bunker. When drainpipes become blocked with sand not only does that have a detrimental impact on the rate at which rainwater is drained from the bunker, it imposes additional workload on grounds staff whom are required to disassemble the drainage system and remove the sand.

Accordingly, there is a need for an improved drainage system that can be installed into golf course bunkers and which are not susceptible to regular blockage that occurs when sand enters the drainpipes.

It is to be understood that, if any prior art is referred to herein, such reference does not constitute an admission that the prior art forms a part of the common general knowledge in the art, in Australia or any other country.

SUMMARY

In one aspect of the present invention there is provided a drainage system comprising a cap comprising one or more sidewalls defining a recess and a body. The body comprises an inlet at a first end of the body, receivable within the recess of the cap, an outlet at a second end of the body, and a passage to allow fluid flow from the inlet to the outlet. The system further comprises a spacer arrangement to space the body from the cap when the inlet is received in the recess of the cap, so as to form a channel to allow fluid flow to the inlet between an outer surface of the body and an inner surface of the cap. The system further comprises a coupling portion for coupling the body to a fluid dispersing pipe for dispersing fluid from the outlet, the coupling portion comprising arms for gripping the fluid dispersing pipe.

Hence, the cap may prevent matter, other than fluid, from entering the passage. So, for example, when the system is buried under e.g. sand, soil, etc. the sand or soil may be prevented from entering the passage, whereas fluid may rise up through the channel and enter the passage (the soil, sand, etc. 'dropping out' in the process).

In one embodiment the spacer arrangement may comprise a mounting portion extending from the cap. The mounting portion may be configured to be received in the passage so as to mount the cap to, and space the cap from, the body. Spacer arrangement may alternatively or additionally comprise one or more ribs projecting from the body so as to engage with the cap when mounted thereto (i.e. to space the cap from the body). The spacer arrangement may form part of the body or the cap, or may be separate from the body and the cap.

In one embodiment the cross-sectional area of the fluid channel may be larger towards the first end than towards the second end. This may reduce the velocity of fluid that is flowing in the channel as it moves towards the inlet, which in turn may reduce the ability of the fluid to carry other (e.g. solid) matter into the inlet.

In one embodiment the outer surface of the body or inner surface of the cap may be tapered between the first and second ends.

In one embodiment the outer surface of the body may be tapered inwardly from the second end to the first end.

In one embodiment the body and the cap may be generally tubular in shape.

The coupling portion may be integral with the body or the cap, or may be separate from the body and the cap. The coupling portion may be configured for temporary or permanent fastening to the fluid dispersing pipe. The fluid dispersing pipe may take any suitable shape.

In one embodiment the drainage system may further comprise a weir portion arranged at the second end of the body. The weir portion may comprise an opening in fluid connection with the dispersing pipe, and a trough at least partially surrounding the opening, such that fluid from the passage is able to collect in the trough and subsequently flow into the opening once the trough is sufficiently full. This may form a second barrier to matter (other than the fluid) entering the fluid dispersing pipe. That is, any matter that enters the passage may drop out of the fluid when it enters the trough (due to a reduction in the velocity of the fluid).

In one embodiment, the weir portion may be integral with the coupling portion.

In one embodiment the drainage system may further comprise a seal member disposed between the coupling portion and the pipe. This may ensure a fluid-tight seal between the coupling portion and the fluid dispersing pipe.

In one embodiment the drainage system may be configured to be buried in a permeable ground layer. The permeable layer may be a sand layer.

In one embodiment the drainage system may further comprise a locator element to allow for location of the drainage system when buried. The locator element may be metal to allow detection of the drainage system using a metal detector.

In one embodiment the drainage system may be for drainage of a bunker on a golf course.

In a further aspect of the present invention there is provided a cap for locating over the end of a drainpipe of a bunker drainage system. The cap comprises one or more sidewalls defining a recess for receipt of an end of the drainpipe. The cap also comprises a spacer arrangement to space the cap from the drainpipe when the inlet is received in the recess of the cap, so as to form a channel to allow fluid to flow to the inlet between an outer surface of the body and an inner surface of the cap.

In a further aspect of the present invention there is provided a drainage system comprising:

- a tubular end cap that has a closed end, an open end and an inner surface that defines a void;
- a drainpipe that has a wall defining an elongate passage for a fluid, the wall having an end portion that has an opening through which a fluid can pass to enter the passage, the wall being such that the end portion is located in the void of the tubular end cap and extends outwardly through the open end of the tubular end cap, an outer surface of the end portion of the wall has a circumference that is less than a circumference of the inner surface of the tubular end cap;
- a spacing arrangement that supports the inner surface of the tubular end cap and the outer surface of the drainpipe in a spaced apart relationship to define a space for the fluid to flow and enter the passage via the opening; and
- a coupling portion for coupling the drainpipe to a fluid dispersing pipe for dispersing fluid from the passage, the coupling portion comprising arms for gripping the fluid dispersing pipe.

As set forth above, a benefit of the above described embodiment of the drainage system is that it reduces the likelihood of bunker sand being drawn into the drainpipe (or body) and blocking the pipe. As elaborated on in more detail in the detailed description section of this specification, the ability to reduce the sand intake comes about from the inner surface of the tubular end cap and the outer surface of the drainpipe being supported in a spaced apart relationship to define a space for the rainwater to flow and enter the passage via the opening or inlet of the drainpipe or body.

In one embodiment the spacing arrangement may comprise an elongate member located in the void of the tubular end cap and which is fixed to the inner surface of the tubular end cap, the elongate member extending into in the passage of the end portion of the drainpipe and is engaged with an inner surface of the end portion of the drainpipe.

Use of the elongate member provides a convenient and secure means for ensuring the inner surface of the tubular end cap and the outer surface of the drainpipe remain in a spaced apart relationship, which as described above contributes to reducing the likelihood of bunker sand entering the drainpipe. As elaborated on in the detailed description of this specification, the elongate member also enables the end cap to be readily fitted and removed from the drainpipe to facilitate easy access to the opening in the drainpipe, which may be required for periodic maintenance of the drainage system.

In one embodiment the elongate member may extend outwardly through the open end of the tubular end cap.

The advantage of having the elongate member extending through the open end of the tubular end cap is that it provides a relatively effective means for guiding the end cap such that it is correctly positioned on the end portion of the drainpipe.

In one embodiment the spacing arrangement may support the opening of the drainpipe and the closed end of the tubular end cap in a spaced apart relationship.

As described in the detailed description of this specification, it is possible for the end portion (e.g. a first end) of the drainpipe to have an open end or a closed end with suitable openings in the wall section of the end portion. However, where the drainpipe has an open end supporting the opening of the drainpipe and the closed end of the tubular end cap in a spaced apart relationship ensures that water is able to freely enter the drainpipe passage via the space or channel defined by the outer wall of the drainpipe end section and the inner surface of the end cap that defines the void.

In a further aspect of the present invention there is provided end cap arrangement for use with a drainage system that comprises a drainpipe that has a wall defining an elongate passage for a fluid, the wall having an end portion that has an opening through which a fluid can pass to enter the passage, the end cap arrangement comprising:

- a tubular body that has a closed end, an open end and an inner surface that defines a void for receiving the end portion of the drainpipe, the inner surface of the tubular body having a circumference that is greater than a circumference of an outer surface of the end portion of the drainpipe; and
- a spacing arrangement for supporting the inner surface of the tubular body and the outer surface of the end portion of the drainpipe in a spaced apart relationship to define a space for the fluid to flow and enter the passage via the opening.

As indicated previously, an advantage of the inner surface of the tubular body and the outer surface of the drainpipe being in a spaced apart relationship is that it helps to reduce bunker sand entering the drainpipe, which could otherwise cause a blockage in the drainpipe.

In one embodiment the spacing arrangement may comprise an elongate member located in the void of the tubular body and which is fixed to the inner surface of the tubular body, the elongate member being arranged to extend into in the passage of the end portion of the drainpipe and engage with an inner surface of the end portion of the drainpipe.

The elongate member ensures the inner surface of the tubular end cap and the outer surface of the drainpipe are in a spaced apart relationship, which reduces the likelihood of bunker sand entering the drainpipe. The elongate member also enables the end cap to be readily fitted and removed from the drainpipe so as to allow easy access to the opening in the drainpipe, which may be required for periodic maintenance of the drainage system.

In one embodiment the elongate member may extend outwardly through the open end of the tubular body.

By extending outwardly through the open end of the tubular body the elongate member allows the tubular end cap to be correctly fitted to the drainpipe.

In one embodiment the spacing arrangement may be arranged to support the opening of the drainpipe and the closed end of the tubular body in a spaced apart relationship.

In embodiments where the drainpipe has a standard open end, supporting the opening of the drainpipe and the closed end of the tubular end cap body in a spaced apart relationship ensures that water is able to freely enter the drainpipe passage via the space defined by the outer wall of the drainpipe end section and the inner surface of the end cap that defines the void.

BRIEF DESCRIPTION OF THE DRAWINGS

Embodiments will now be described by way of example only, with reference to the accompanying drawings in which:

FIG. 12*a* is a sectional view of FIG. 12*b*, taken through FIG. 12*a*-FIG. 12*a*.

DETAILED DESCRIPTION

Figure 1:
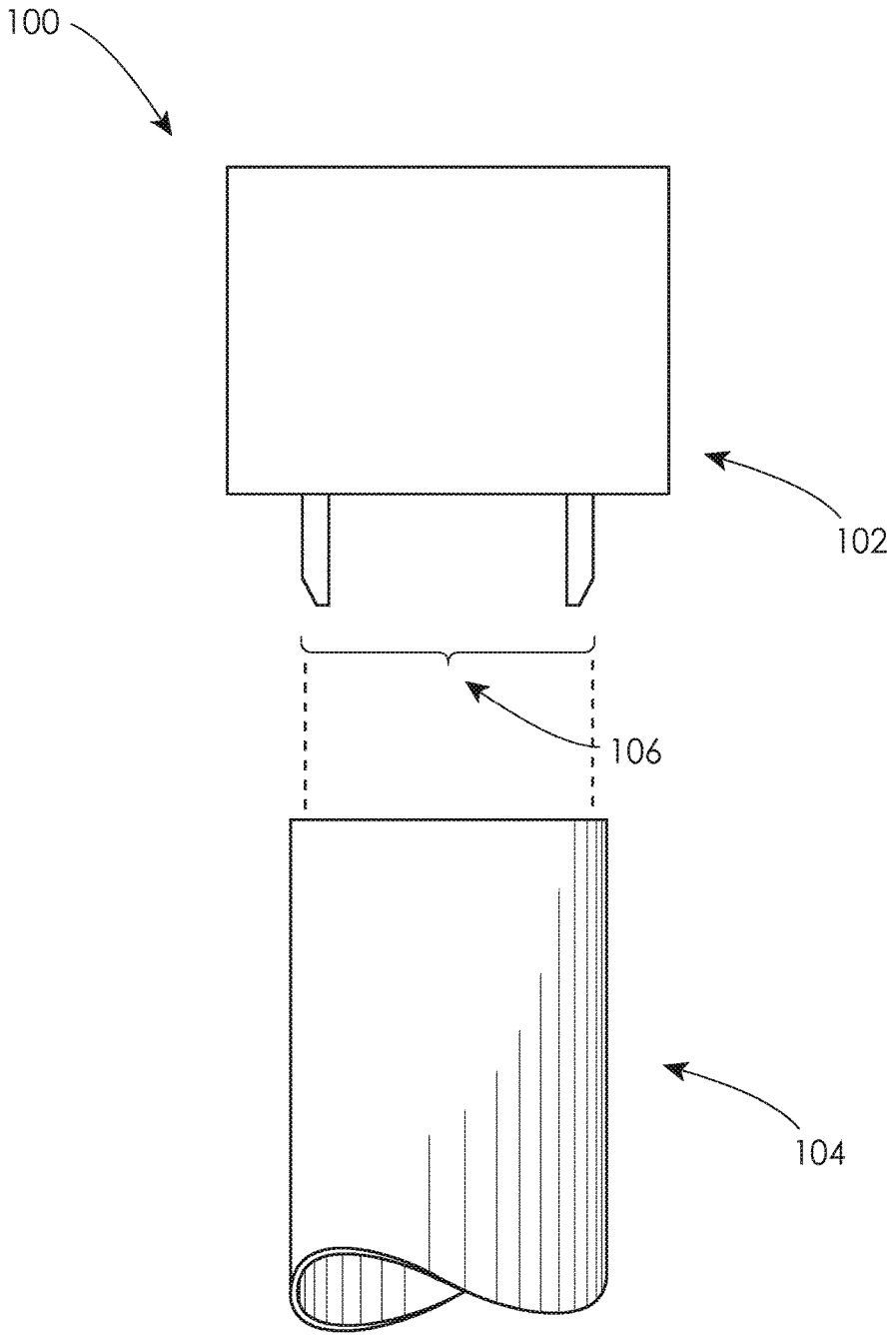
FIG. 1 depicts a drainage system according to an embodiment of the present invention.

In the following detailed description, reference is made to accompanying drawings which form a part of the detailed description. The illustrative embodiments described in the detailed description, depicted in the drawings and defined in the claims, are not intended to be limiting. Other embodiments may be utilised and other changes may be made without departing from the spirit or scope of the subject matter presented. It will be readily understood that the aspects of the present disclosure, as generally described herein and illustrated in the drawings can be arranged, substituted, combined, separated and designed in a wide variety of different configurations, all of which are contemplated in this disclosure.

Where similar features are illustrated in multiple figures, similar reference numbering has been used across those figures. I.e. the final two digits of each reference numeral indicates a given feature, with the preceding digits indicating the figure number.

Referring to FIG. 1, an embodiment of the drainage system 100 comprises a cap 102 having a tubular form, a drainpipe (or body) 104 and a mounting portion forming a spacing arrangement 106. In this embodiment of the drainage system 100 the end cap 102, the drainpipe 104 and the spacing arrangement 106 are all made from a high density polyethylene (HDPE) and polyvinyl chloride (PVC) thermoplastic. However, it is envisaged that in other embodiments of the present invention some, or all of, the end cap 102, drainpipe 104 and spacing arrangement 106 are made from materials other than PVC thermoplastic such as, for example, a metal.

Figure 2:
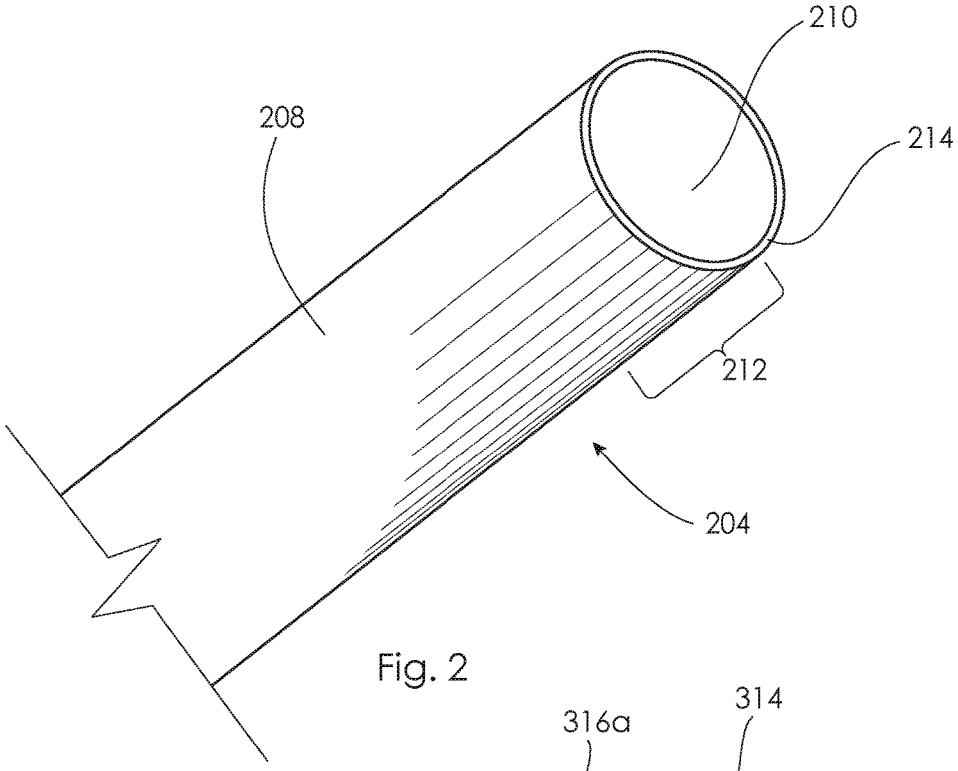
FIG. 2 shows a drainpipe used in the drainage system of FIG. 1.
Figure 3:
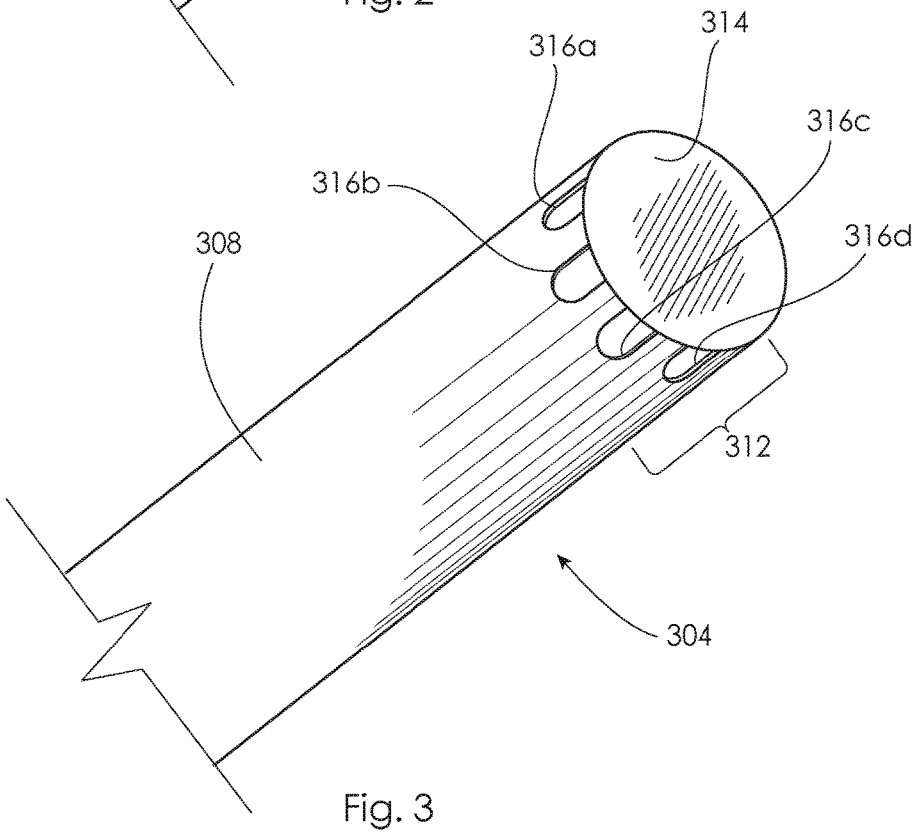
FIG. 3 illustrates an alternative drainpipe used in a different embodiment of the present invention.

Referring to FIG. 2, the drainpipe 204 is made of a wall 208. The wall 208 is approximately 3 mm in thickness, but a different thickness wall 208 can be used in other embodiments of the invention. The wall 208 defines a passage 210 which carries water (or for that matter other fluids) through the drainpipe 204. The wall 208 has an end portion (i.e. first end) 212 that has an open end (or inlet) 214 through which water can pass and enter the passage 210 of the drainpipe 204. While this embodiment of the invention uses a drainpipe 204 with an open (first) end 214, alternative openings are suitable. For example, referring to FIG. 3 the entire open end 214 shown in FIG. 2 might be completely sealed and instead the drainpipe 304 has a series of openings 316*a*-316*d* in the wall 308 of the drainpipe 304.

Figure 4:
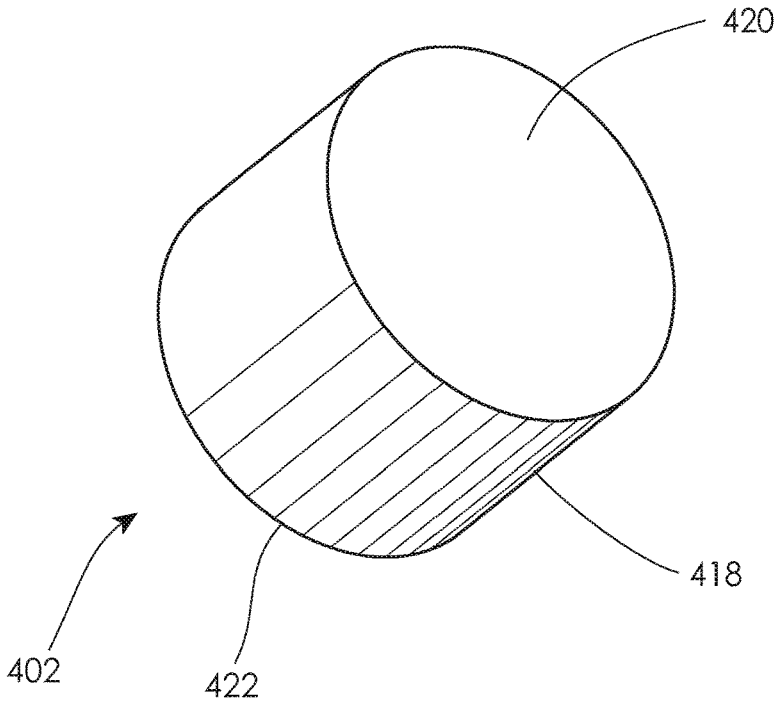
FIG. 4 shows a drainpipe end cap used in the drainage system depicted in FIG. 1.
Figure 5:
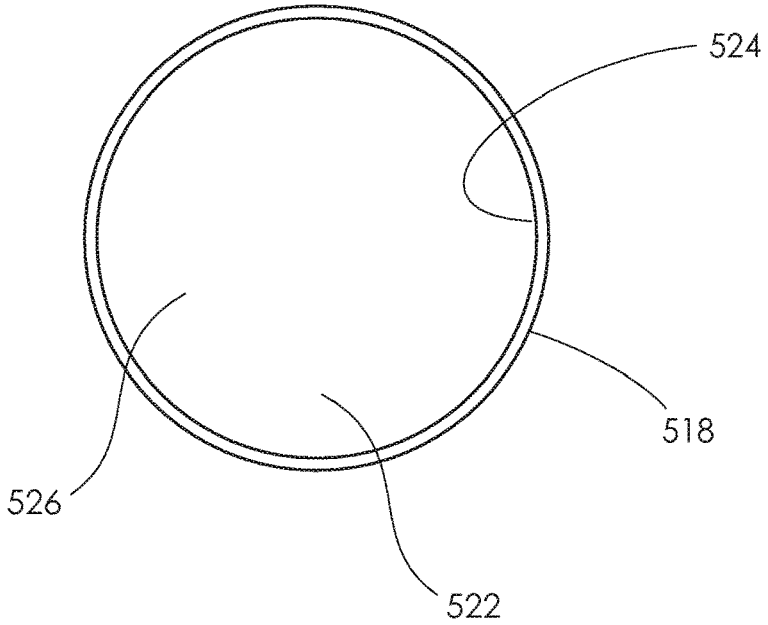
FIG. 5 shows a view looking into an open end of the drainpipe end cap of FIG. 4.

With reference to FIG. 4, the end cap 402 has a tubular body 418 that defines a recess and that has a closed end 420 and an open end 422. While the closed end 420 is shown as being flat it is envisaged that in alternative embodiments of the end cap 402 the closed end 420 could be domed (see FIG. 14). Referring to FIG. 5 which is a view looking into the open end 522 of the tubular body 518, the tubular body 518 has an inner surface 524 that defines a void (or recess) 526. The void 526 extends from the open end 522 of the tubular body 518 to the closed end 420 (shown only in FIG. 4) of the tubular body 518.

Figure 6:
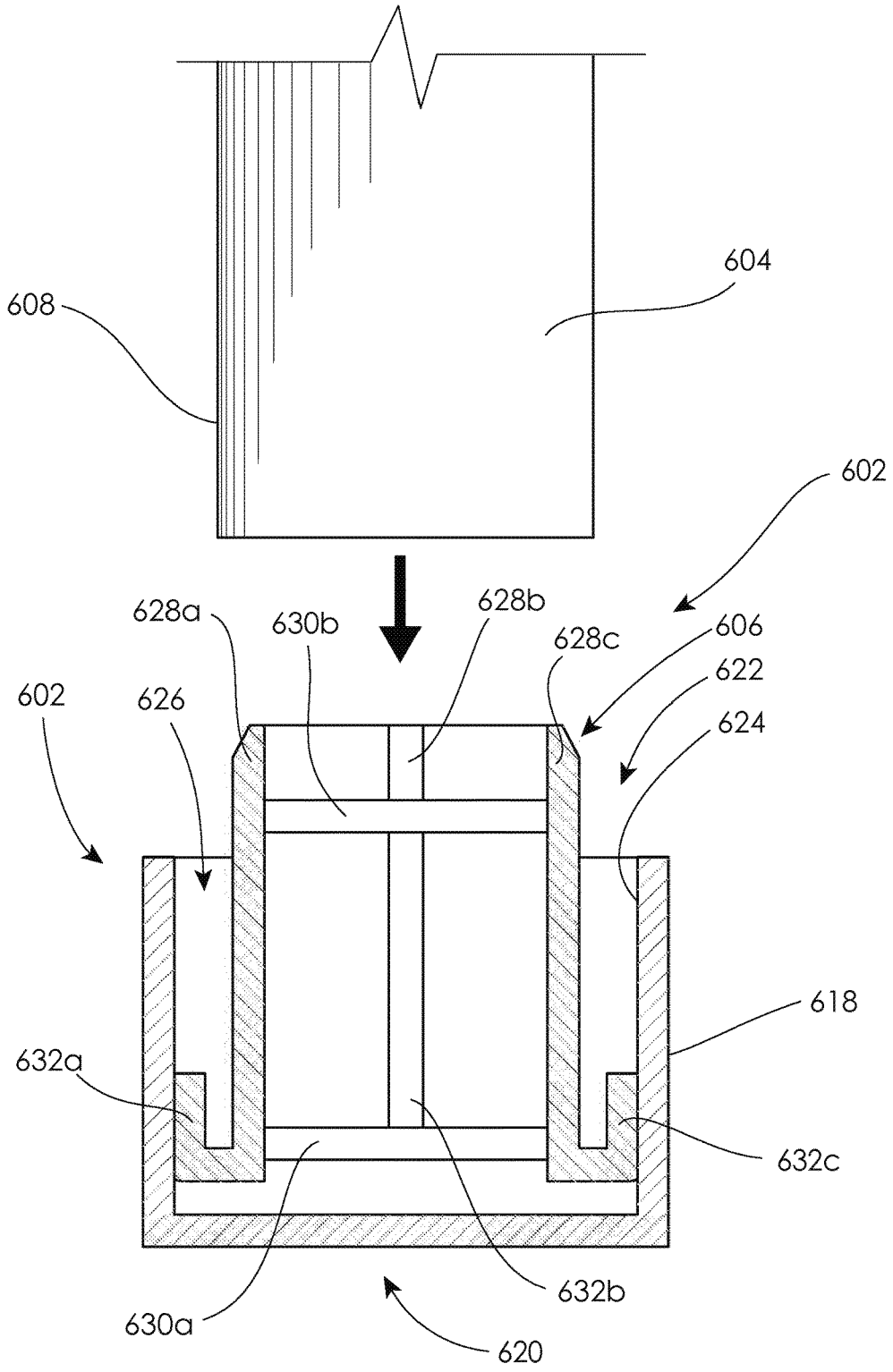
FIG. 6 is a cross-sectional view looking of the drainpipe end cap of FIGS. 4 and 5.
Figure 7:
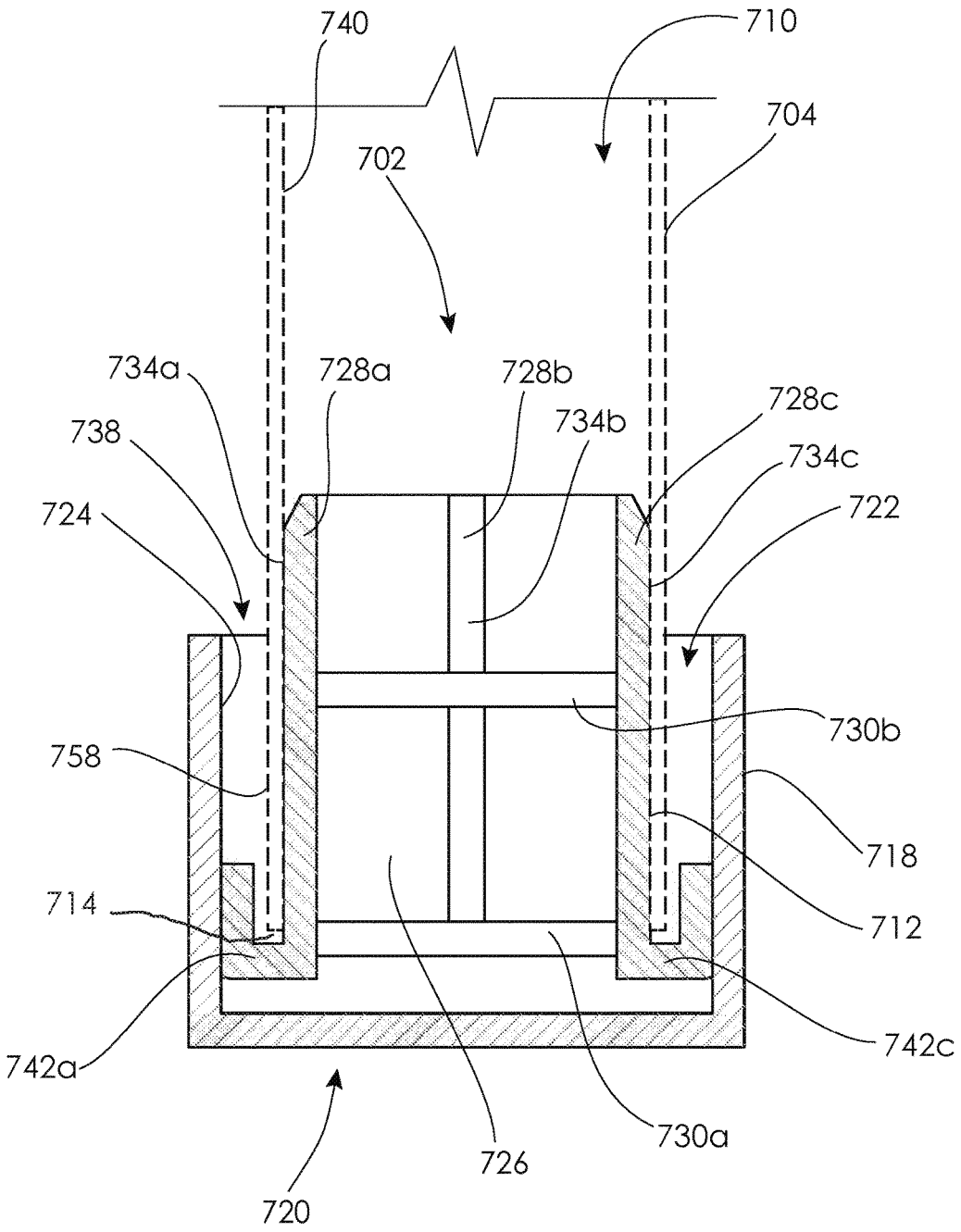
FIG. 7 is another cross-sectional view of the drainpipe end cap of FIGS. 4 to 6.

As described previously with reference to FIG. 1, the drainage system 100 includes a spacing arrangement 106. Referring to FIG. 6, which shows a cross-sectional view of the drainpipe end cap 602, the spacing arrangement 606 comprises three elongate members 628*a-c*. The elongate members 628*a-c* are fixed to two circular disks 630*a* and 630*b* such that the elongate members 628*a-c* are held in a spaced apart relationship to each other. Each of the elongate members 628*a-c* has a lower section 632*a-c* that is secured to the inner surface 624 of the drainpipe end cap 602. As can be seen in FIG. 7, the outer surfaces 734*a-c* of the elongate members 728*a-c* are spaced apart from the inner surface 724 of the tubular body 718 of the end cap 702. Spacing the outer surfaces 734*a-c* of the elongate members 728*a-c* apart from the inner surface 724 of the end cap 702 tubular body 718 defines a space 738 for receiving the drainpipe 704 such that the end portion 712 of the drainpipe 704 can be located in the void (or recess) 726 of the end cap 702.

The drainpipe end cap 702 is arranged to be fitted to the open end 214 (see FIG. 2) of the drainpipe 704. In this regard, the elongate members 728*a-c* extend outwardly from the void 726 and past the open end 722 of the end cap 702 tubular body 718. By extending outwardly past the open end 722 the elongate members 728*a-c* act as a guide when the end cap is being fitted to the open end 214 of the drainpipe 704. It is also noted that this spacing arrangement allows for ready removal and fitting of the end cap 702 to the drainpipe 704 open end 714. The circular disks 730*a* and 730*b* hold the elongate members 728*a-c* at a distance apart which is such that the outer surfaces 734*a-c* of the members 728*a-c* can be inserted into the passage 710 of the drainpipe 704 via the open end 714 in the end portion 712 of the drainpipe 704. When inserted in the passage 710 of the drainpipe 704 the outer surfaces 734*a-c* of the members 728*a-c* are positively engaged with the inner surface 740 of the drainpipe 704. Each of the elongate members 728*a-c* also have a bottom section 742*a-c* that engages with the open end 714 in the end portion 712 of the drainpipe 704. Because the bottom section 742*a-c* of the elongate members 728*a-c* is spaced apart from the closed end 720 of the end cap 702 tubular body 718, the open end 714 of the drainpipe 704 is spaced apart from the closed end 720 of the drainpipe end cap 702 tubular body 718. As discussed in more detail in the following sections of this specification, spacing the open end 714 of the drainpipe 704 allows water to enter the passage 710 of the drainpipe 704 when the end cap 702 is fitted to the end section 712 of the drainpipe 704.

Figure 8:
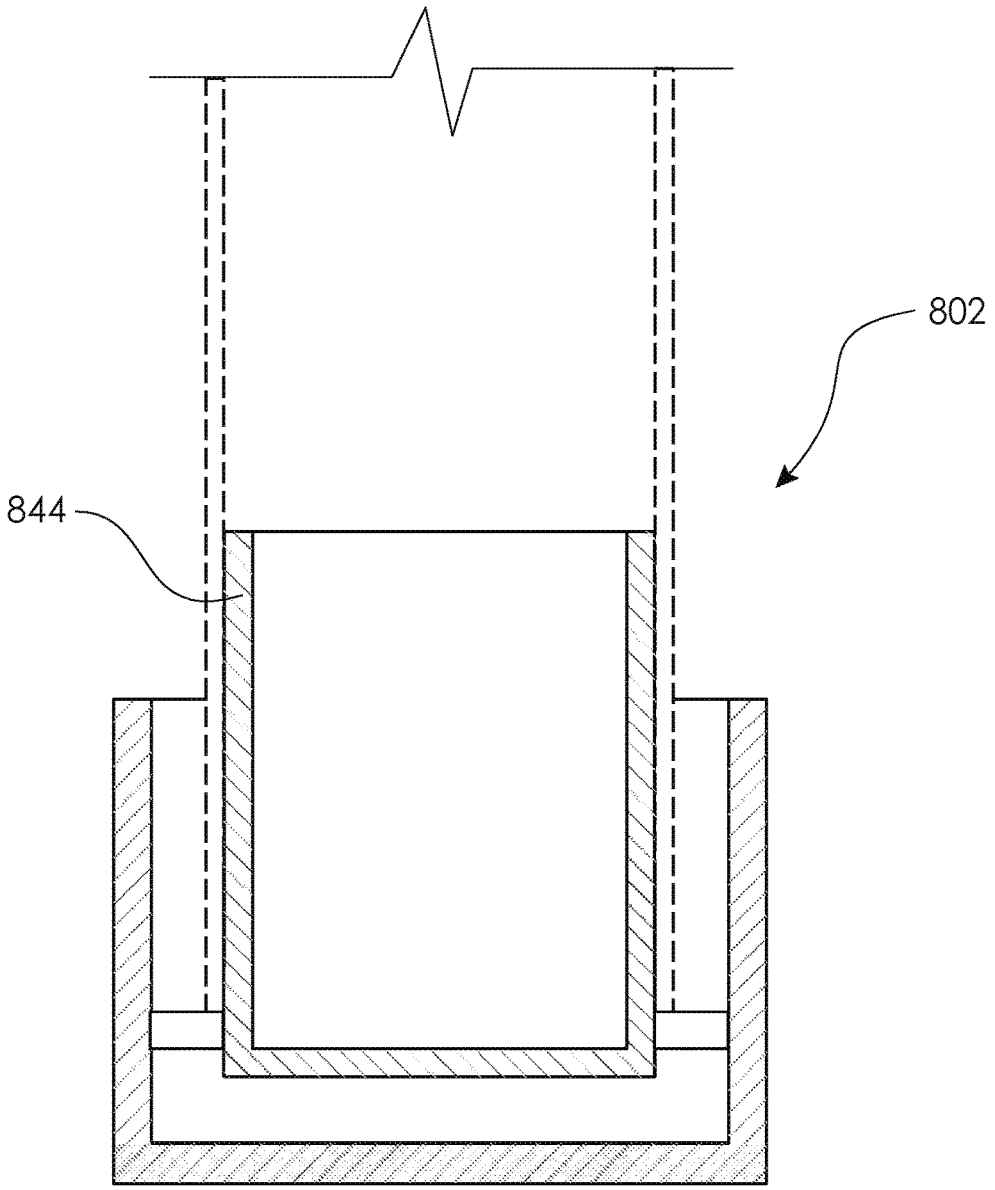
FIG. 8 is an alternative embodiment of the spacing arrangement used with the drainpipe end cap of FIGS. 4 to 7.
Figure 9:
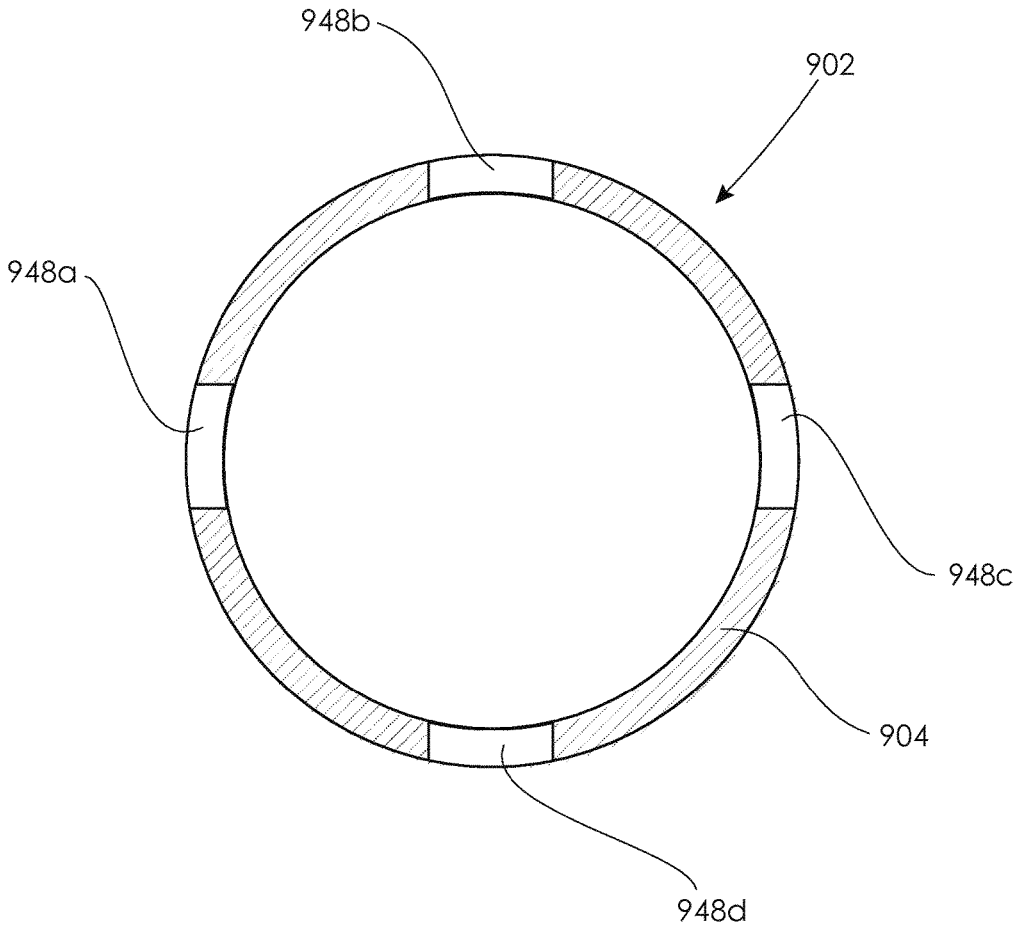
FIG. 9 is yet a further alternative embodiment of the spacing arrangement used with the drainpipe end cap of FIGS. 4 to 7.

It is envisaged that alternative embodiments of the present invention could readily use different spacing arrangements (see FIGS. 13*a*, 13*b* and 14) to that which has been described with reference to the three elongate members 728*a-c* and the two disks 730*a* and 730*b*. For example, one such alternative embodiment could employ a spacing arrangement in which the three elongate members 728*a-c* are replaced with a single length of unitary pipe, which is illustrated in FIG. 8. This alternative embodiment is shown in FIG. 8 (which is a cross-sectional view), in which the end cap 802 has a unitary piece of pipe 844 instead of the three separate elongate members 728*a-c* of FIG. 7. In a further alternative embodiment, the spacing arrangement may not be fixedly connected to the drainpipe end cap as previously described, instead the spacing arrangement may be a separate item that is fitted to the end portion 212 of the drainpipe 204 of FIG. 2. This alternative embodiment is illustrated in FIG. 9 which shows an end cross-sectional view of the drainpipe 904 with the end cap 902 fitted thereto. In this alternative embodiment the spacing arrangement comprises four elongate members 948*a-d* fixed to the outer surface of the end section of the drainpipe 904. The elongate members 948*a-d* are evenly spaced around the circumference of the wall of the drainpipe 904. Like the elongate members 728*a-d* shown in FIG. 7, the elongate members 948*a-d* of this alternative embodiment have an outer surface that engages with the inner surface of the drainpipe end cap 902.

Figure 10:
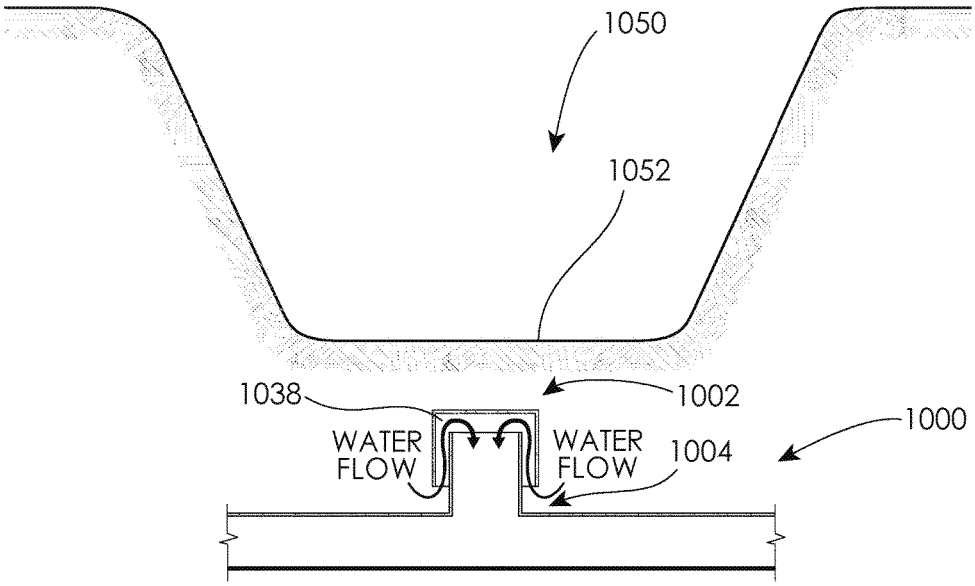
FIG. 10 shows an installation of the drainage system of FIG. 1 in a golf course bunker.
Figure 11:
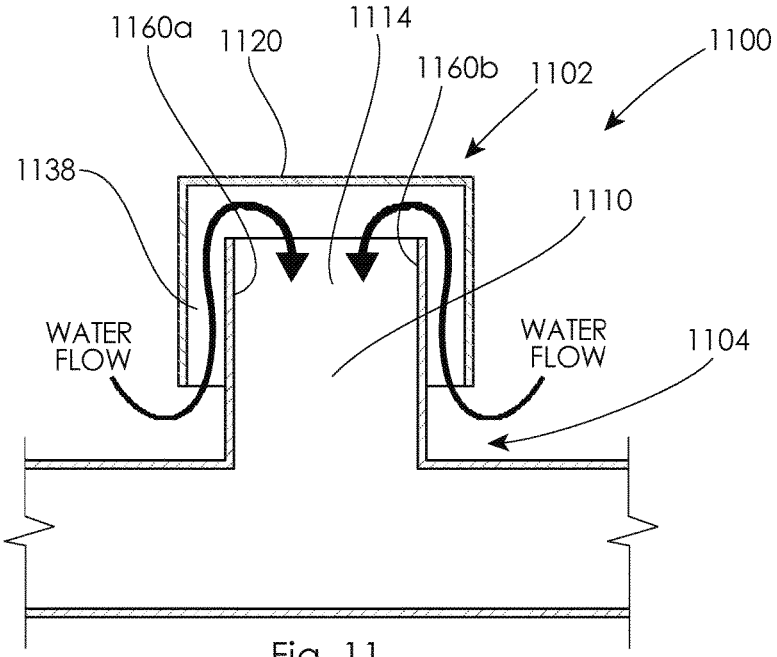
FIG. 11 shows a close-up view of the in-situ drainage system shown in FIG. 10.

In turning now to describing how the drainage system 100 facilitates drainage of bunkers in a golf course, reference is made to FIG. 10. As described previously, the drainage system 1000 comprises a tubular end cap 1002 and a drainpipe 1004. For the sake of clarity, the previously mentioned spacing arrangement is not shown in FIG. 10. When installed in a bunker 1050, both the end cap 1002 and the drainpipe 1004 are buried below the surface level of the sand 1052. The section of the drainpipe 1004 to which the end cap 1002 is fitted is generally positioned vertically. As shown in FIG. 7, there is a space 738 that is defined by the outer surface 758 of the drainpipe 704 and the inner surface 724 of the drainpipe end cap 702. This space 738 is the result of the outer surface 758 of the drainpipe 704 having a circumference that is less than the circumference of the inner surface 724 of the end cap 702. In turning again to FIG. 10, this space 1038 enables water below the surface of the sand 1052 to enter the drainpipe 1004 and be drained away while minimizing the amount of sand that enters the drainpipe 1004. More specifically, as rainwater collects in the bunker 1050 it will settle below the surface level of the bunker sand 1052. As it continues to rain the level of rainwater below the surface of the sand 1052 will rise causing it to enter the space 1038 and pass therethrough. With reference to FIG. 11, which illustrates a closer view of the in-situ drainage system 1100. As the level of rainwater in the space 1138 rises towards the closed end 1120 of the end cap 1102, which act like a weir, the rainwater will spill over the lips 1160*a* and 1160*b* of the drainpipe 1104 and into the passage 1110 via the drainpipe opening 1114. Because the rainwater passes up through the space 1138 minimal bunker sand 1052 enters the drainpipe opening 1114. Because of the weight of the sand it is not drawn up with the water as it rises in level in the passage 1138. The closed end 1120 of the end cap 102 prevents any bunker sand from falling into the drainpipe open end 1114. As previously described the drainpipe end cap 1102 and the drainpipe 1104 are buried beneath the surface level of the bunker sand 1052.

Figure 12A:
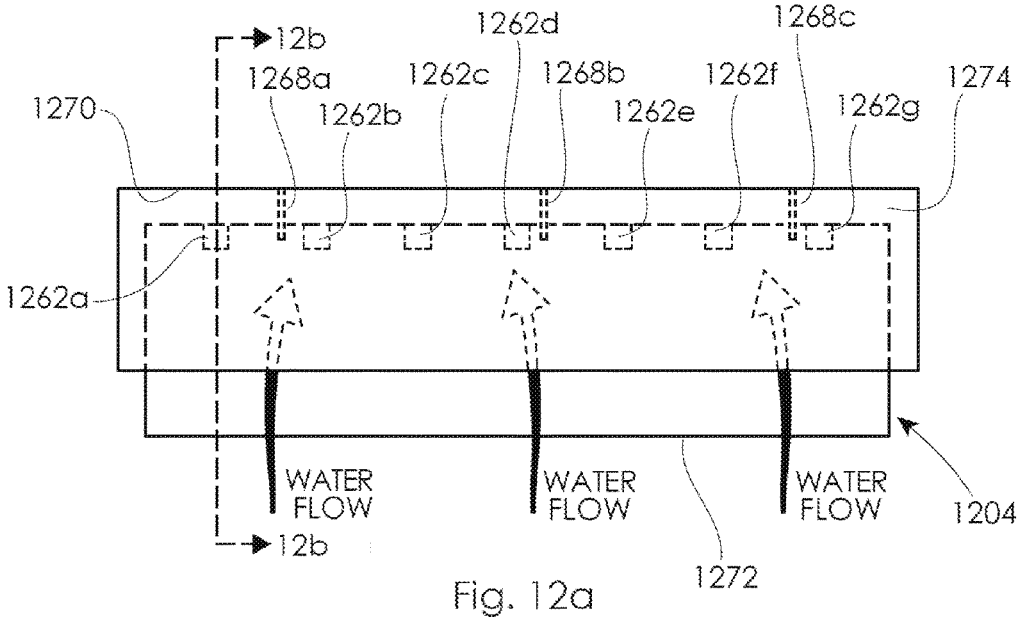
FIGS. 12*a* and 12*b* show an alternative embodiment of the drainage system, where
Figure 12B:
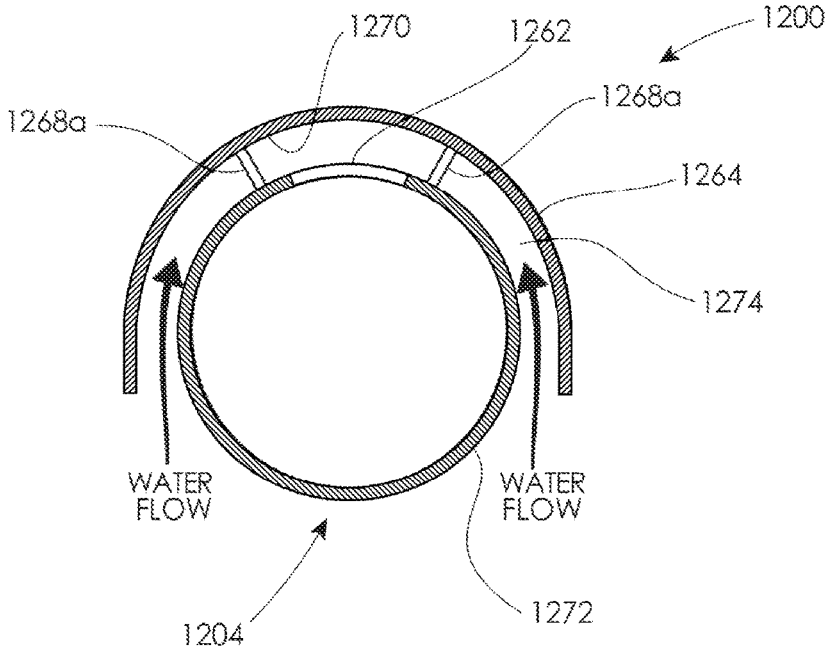

While the preceding description of an embodiment of the present invention is described in the context of an open-ended drainpipe with an end cap fitted thereto, it is possible that the present invention could be embodied in different arrangements. One such example of an alternative embodiment is shown in FIGS. 12*a* and 12*b*. Instead of an open-ended drainpipe with an end cap fitted thereto as described previously, FIG. 12*a* shows a side profile of the drainage system 1200, while FIG. 12*b* shows a sectional profile of the drainage system 1200, taken through the line FIG. 12*a*-FIG. 12*a*. The system 1200 employs a closed end drainpipe 1204. Instead of having an open end to allow water to enter the drainpipe 1204, the drainpipe 1204 has a series of openings 1262*a-g* in the top of the drainpipe 1204. As an alternative to a drainpipe endcap, the drainage system 1200 employs an elongate shroud 1264 that extends longitudinally along the length of the drainpipe 1204. This alternative embodiment also uses a spacing arrangement 1268*a-c* which holds an inner surface 1270 of the shroud 1264 in a spaced apart relationship to an outer surface 1272 of the drainpipe 1204 to thereby form a space 1274, which as described in relation to the previous embodiment, allows water in the bunker to flow up therethrough and into the drainpipe 1204 openings 1262*a-g*.

In the embodiment described above, and shown in FIGS. 1 to 12*b*, the drainpipe of the drainage system is of a generally circular or cylindrical tubular form, with a constant cross-section along its length (defined by a single wall). Like the embodiments above, the drainpipe (or body, as it will now be referred to) 1304 of the embodiment 1300 shown in FIGS. 13*a* and 13*b* comprises a generally tubular form defining a passage 1310 for fluid flow, but the tubular form of this embodiment has a cross section that varies along its length. This will be discussed in more detail below.

The cap 1302 of this embodiment comprises a dome-like top portion (see 1402 of FIG. 14) and a curved sidewall 1318 in the form of a skirt extending downwardly, in use, from the top portion 1320 so as to define a recess or void 1326. The cap 1302 further comprises a mounting portion 1306 that extends within the recess 1326 and generally from the centre of an inner surface of the top portion 1320. The mounting portion 1306 comprises six evenly spaced support ribs 1376 extending radially from a common central axis (i.e. so as to form a generally elongate portion with a star shaped cross-section). An outer edge of each support rib 1376 generally corresponds to the form of a curved inner surface 1378 of the body 1304 (defining the passage 1310 of the body). Thus, in use, the cap 1302 can be mounted to the body 1304 by inserting the mounting portion 1306 into the passage 1310 of the body 1304, such that the outer edges of the support ribs 1376 rest against and engage the inner surface 1378 of the body 1304. To facilitate this mounting, a plurality of longitudinal guide ribs 1380 project from the inner surface 1378 of the body 1304 (defining the passage 1310), such that when the cap 1302 is mounted to the body 1304 (and during mounting), the support ribs 1376 locate between the guide ribs 1380.

The shape of the support ribs 1376, and the cap 1302 in general, creates a spacing arrangement such that when the mounting portion 1306 is inserted into the passage 1310 (i.e. to mount the cap 1302 to the body 1304) the inner surface 1324 of the cap 1302 is spaced from the outer surface 1382 of the body 1304. The second end 1384 of the body 1304 additionally comprises spacing projections 1386 that also form part of the spacing arrangement (in addition to the mounting portion 1306) and engage the inner surface 1324 of the cap 1302 and maintain the spacing between the cap 1302 and the body 1304. In this way, a channel 1326 is formed between the cap 1302 and the body 1304 to allow fluid to flow to the inlet 1314 of the body 1304 and into the passage 1310.

As mentioned above, the body 1304 does not have a constant cross-section along its length. The outer surface 1382 of the body 1304 tapers inwardly from its second (lower) end 1384 at the outlet 1388 of the passage 1310, to its first (upper) end 1312 at the inlet 1314. As a result, when the cap 1302 is mounted to the body 1304, the cross-sectional area of the fluid channel 1326 (between the cap 1302 and the body 1304) increases with proximity to the first end 1312 or inlet 1314. As a result of this arrangement, fluid that is passing through the fluid channel (see FIG. 14, channel 1438) decreases in velocity as it moves from the second end 1384 of the body 1304 to the first end of the body 1304. This decrease in velocity may help to ensure that the fluid has insufficient energy to carry solids (e.g. sand, dirt, etc.) into the passage 1310.

The inner surface 1378 of the body 1304 has a curved form. In general (depending on the type, flow rate, etc. of the fluid), surface tension in the fluid may cause it to flow along this inner surface 1378 rather than drop down the centre of the passage 1310.

At the second end 1384 (i.e. adjacent the outlet 1388) the body 1304 is mounted to a coupling portion 1390, which allows the drainage system 1300 to be coupled to e.g. a fluid dispersing pipe 1391. The coupling portion 1390 comprises a generally tubular side wall 1392 that couples with the body 1304 so as to create a fluid-tight seal between the coupling portion 1390 and the body 1304. A generally planar base 1393 extends across the coupling portion 1390 (i.e. bounded by the tubular sidewall 1392), and a weir portion 1394, also having a tubular pipe shape, extends through the planar base 1393.

Hence, on an upper side of the planar base 1393 of the coupling portion 1390 (adjacent the outlet 1388 of the body 1304) a trough is formed between the weir portion 1394 and the sidewall 1392 of the coupling portion 1390. The lower side (e.g. underside) of the coupling portion 1390 comprises a tubular projection 1395 that extends from the planar base 1393 and fits within an aperture 1397 in the fluid dispersing pipe 1391.

The coupling portion 1390 further comprises curved arms 1396 that extend from the lower side of the planar base 1393 and are shaped so as to grip the fluid dispersing pipe 1391 (i.e. at the location of the opening 1397).

Figure 13A:
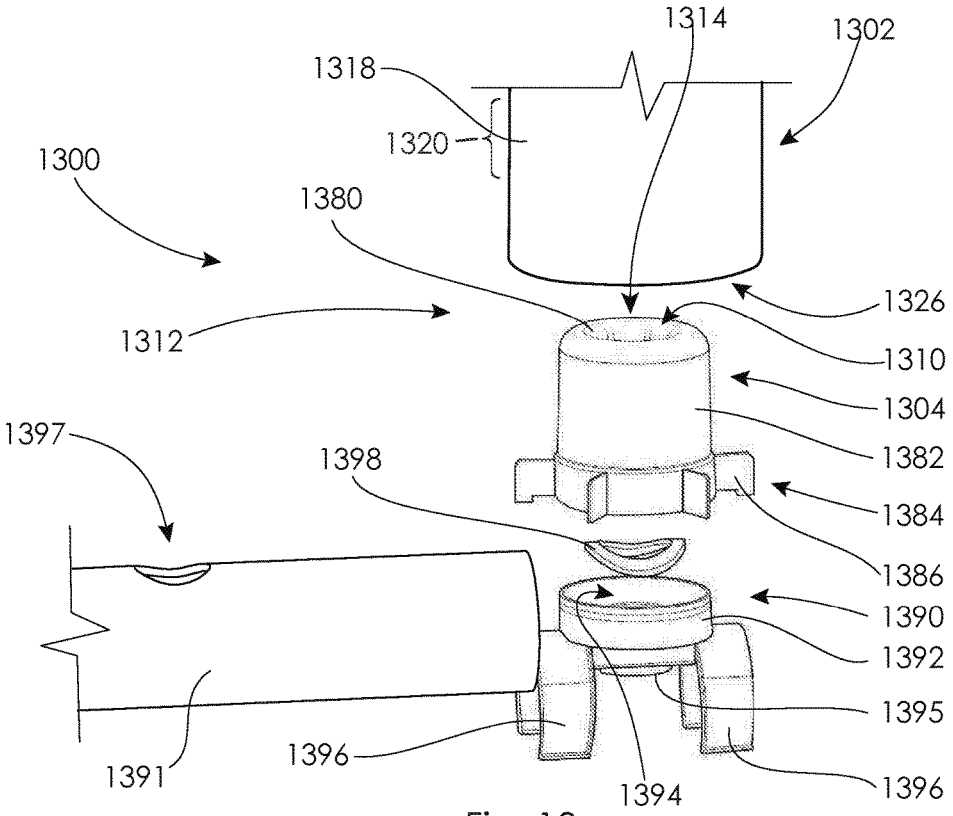
FIGS. 13*a* and 13*b* show exploded views of a further alternative embodiment of the drainage system.
Figure 13B:
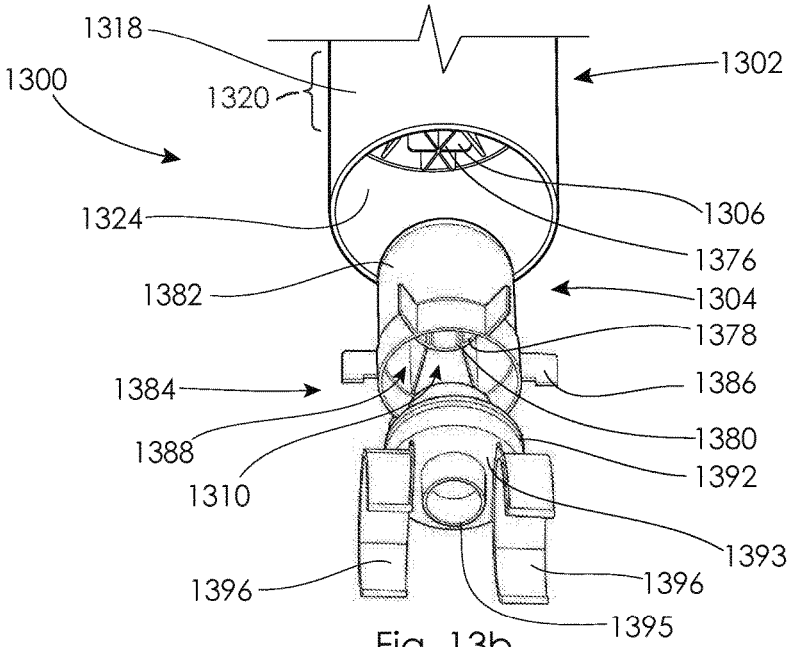

The system further comprises a sealing member, in the form of a foam ring 1398. In FIGS. 13*a* and 13*b*, this ring 1398 is shown between the body 1304 and the coupling portion 1390. However, in use, this ring 1398 is positioned between the fluid dispersing pipe 1391 and the coupling portion 1390 (around the projecting part of the weir portion 1394) so as to create a fluid seal between the pipe 1391 and the coupling portion 1390.

In use, fluid passes from the passage 1310 of the body into the coupling portion 1390 and collects in the trough. Once the level of water reaches the top of the weir portion 1394, it flows from the trough through the centre of the weir portion 1394 and into the fluid dispersing pipe 1391. This weir portion 1394 provides a secondary barrier to solids that may have passed into the inlet 1314 of the body 1304 and through the passage 1310.

Figure 14:
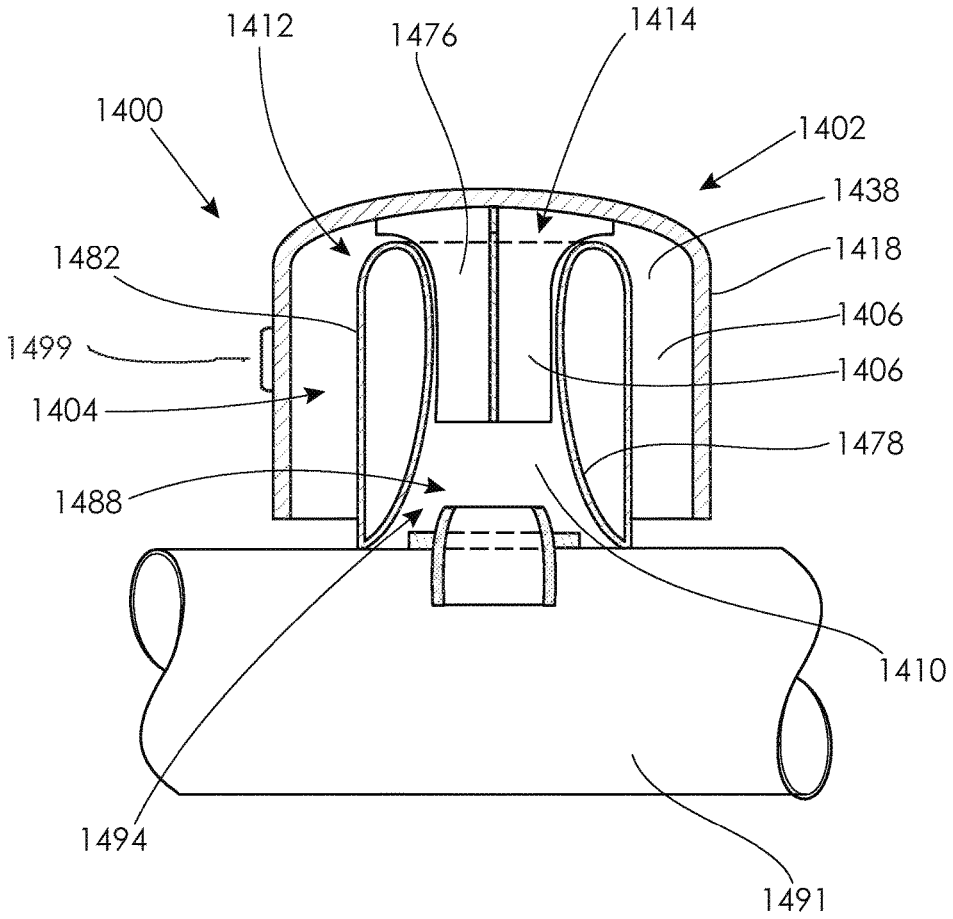
FIG. 14 is a section view of a variation of the embodiment of the drainage system shown in FIGS. 13*a* and 13*b*.

FIG. 14 shows a variation of the embodiment shown in FIGS. 13*a* and 13*b* and described above. This Figure is provided for the purpose of showing an exemplary internal structure of the cap and body of the embodiment shown in FIGS. 13*a* and 13*b* (albeit with minor variations). Hence, similar numbering has been used in this Figure.

Also apparent from FIG. 14 is the weir portion 1494 that defines a trough around an opening (that leads to the pipe 1491), except that the trough is bounded by the weir portion 1494 and the body 1404 (rather than by the sidewall of the weir portion as is the case in FIGS. 13*a* and 13*b*).

Variations and modifications may be made to the parts previously described without departing from the spirit or ambit of the disclosure.

For example, the drainage system may comprise a locator element to allow for location of the system when buried under e.g. sand in a bunker. This locator element may, for example, be in the form of metal part (e.g. disc, ring, plate, etc.) that is affixed to the drainage system. This would allow the drainage system to be detected by a metal detector. The locator element may otherwise be a transponder emitting a signal, for example a near-field communication (NFC) tag, radio-frequency identification (RFID) tag, etc.

The drainage system may additionally or alternatively comprise a levelling device 1499 (as shown in FIG. 14). For example, the levelling device 1499 may be a bullseye level mounted to the drainage system (e.g. on the cap). This may allow an installer of the drainage system to ensure that the body and cap are level when positioned on a water dispersing pipe.

The body or drainpipe of the drainage system may not have a circular cross-section. It may instead take any other suitable form (e.g. conical, box-like, etc).

The various portions of the drainage system (e.g. drainpipe, cap, base portion) may be formed as separate connectable pieces, or may be integrally formed as a single part.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the drainage system.

The invention claimed is:

1. A drainage system configured to be buried in a permeable ground layer, the system comprising:
- a cap of a type that comprises an end wall and one or more sidewalls that extend from a perimeter of the end wall to define a recess within the cap;
- a body comprising:
  - an inlet at a first end of the body, receivable within the recess of the cap;
  - an outlet at a second end of the body; and
  - a passage to allow fluid flow from the inlet to the outlet;
- a spacer arrangement comprising a mounting portion that extends from within the cap, the mounting portion configured to be received within the passage at the first inlet end of the body such that, when the inlet is received in the recess of the cap, the mounting portion locates within the passage at the first inlet end to mount the cap to the body, the spacer arrangement being further configured to space said one or more sidewalls of the cap from the body such that, when the inlet is received in the recess of the cap, a channel is formed between an inner surface of said one or more sidewalls of the cap and an outer surface of the body, with the channel that is formed having a cross-sectional width that is less than a length of the channel, whereby fluid is able to flow through the channel to the inlet at the first end of the body; and a coupling portion for coupling the body to a fluid dispersing pipe for dispersing fluid from the outlet, the coupling portion comprising arms for gripping the fluid dispersing pipe.

2. The drainage system as claimed in claim 1 wherein a cross-sectional area of the channel is larger towards the first end than towards the second end of the body.

3. The drainage system as claimed in claim 2 wherein the outer surface of the body or inner surface of the cap is tapered between the first and second ends of the body.

4. The drainage system as claimed in claim 3 wherein the outer surface of the body is tapered inwardly from the second end to the first end of the body.

5. The drainage system as claimed in claim 1 wherein the body and the cap are generally tubular in shape.

6. The drainage system as claimed in claim 1 comprising a weir portion arranged at the second end of the body, the weir portion comprising an opening in fluid connection with the dispersing pipe, and a trough at least partially surrounding the opening, such that fluid from the passage is able to collect in the trough and subsequently flow into the opening once the trough is sufficiently full.

7. The drainage system as claimed in claim 6 wherein the weir portion is integral with the coupling portion.

8. The drainage system as claimed in claim 1 further comprising a seal member disposed between the coupling portion and the fluid dispersing pipe.

9. The drainage system as claimed in claim 1 wherein the permeable layer is a sand layer.

10. The drainage system as claimed in claim 1 further comprising a locator element to allow for location of the drainage system when buried.

11. The drainage system as claimed in claim 1 that is for drainage of a bunker on a golf course.

12. The drainage system as claimed in claim 1 further comprising a levelling device mounted to the cap.

13. A cap for locating over the end of a drainpipe of a bunker drainage system, the cap of a type that comprises:

an end wall;

one or more sidewalls that extend from a perimeter of the end wall to define a recess for receipt therein of the drainpipe end;

a spacer arrangement comprising a mounting portion that extends from within the cap, the mounting portion configured to be received within an opening at the drainpipe end such that, when the drainpipe end is received in the recess of the cap, the mounting portion locates within the drainpipe opening to mount the cap to the drainpipe, the spacer arrangement being further configured such that, when the drainpipe end is received in the recess of the cap, said one or more sidewalls of the cap are spaced from the drainpipe so as to form a channel that has a cross-sectional width that is less than a length of the channel, with the channel that is formed being arranged to allow fluid to flow to the opening at the drainpipe end between an outer surface of the drainpipe and an inner surface of the cap.

14. The cap as claimed in claim 13 wherein a cross-sectional area of the channel is larger at an end of the channel that is adjacent to the drainpipe end than the cross-sectional area of the channel at a fluid entrance to the channel.

15. The cap as claimed in claim 14 wherein the outer surface of the drainpipe or inner surface of the cap is tapered between said channel end adjacent to the drainpipe end and said channel entrance.

16. A drainage system comprising:

a tubular-type end cap that has a closed end, an open end and an inner surface that defines a void;

a drainpipe that has a wall defining an elongate passage for a fluid, the wall having an end portion that has an opening through which a fluid can pass to enter the passage, the wall being such that, when the end portion is located in the void of the tubular-type end cap and extends outwardly through the open end of the tubular-type end cap, an outer surface of the end portion of the wall has a circumference that is less than a circumference of the inner surface of the tubular-type end cap; and a spacer arrangement comprising a mounting portion that extends from within the void of the cap, the mounting portion configured to be received within the opening at the end portion of the wall such that, when the wall end portion is located in the void of the tubular-type end cap, the mounting portion locates within the opening to mount the tubular-type end cap to the drainpipe, the spacer arrangement being further configured such that, when the wall end portion is located in the void of the tubular-type end cap, said inner surface of the tubular-type end cap is supported in a spaced apart relationship from said outer surface of the end portion of the wall to define a space in the form of a channel that has a cross-sectional width that is less than a length of the channel, with the channel that is formed being arranged to allow for the fluid to flow between the outer surface of the end portion of the wall and the inner surface of the tubular-type end cap to enter the passage via the opening; and a coupling portion for coupling the drainpipe to a fluid dispersing pipe for dispersing fluid from the passage, the coupling portion comprising arms for gripping the fluid dispersing pipe.

17. The drainage system as claimed in claim 16 wherein a cross-sectional area of the channel is larger at an end of the channel that is adjacent to the passage opening than the cross-sectional area of the channel at a fluid entrance to the channel.

18. The drainage system as claimed in claim 17 wherein the outer surface of the drainpipe or inner surface of the tubular end cap is tapered between said channel end adjacent to the passage opening and said channel entrance.

19. The drainage system as claimed in claim 16 comprising a weir portion arranged at an opposite end of the passage, the weir portion comprising an opening in fluid communication with the dispersing pipe, and a trough at least partially surrounding the weir portion opening, such that fluid from the passage is able to collect in the trough and subsequently flow into the weir portion opening once the trough is sufficiently full.

* * * * *